US008789386B2

(12) United States Patent
Fotiadis et al.

(10) Patent No.: US 8,789,386 B2
(45) Date of Patent: Jul. 29, 2014

(54) REFRIGERATING DEVICE WITH COOLING OF CIRCULATING AIR

(75) Inventors: Panagiotis Fotiadis, Giengen (DE); Alexander Görz, Aalen (DE); Hans Ihle, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1705 days.

(21) Appl. No.: 11/918,598

(22) PCT Filed: Apr. 3, 2006

(86) PCT No.: PCT/EP2006/061278

§ 371 (c)(1),
(2), (4) Date: Oct. 15, 2007

(87) PCT Pub. No.: WO2006/120086

PCT Pub. Date: Nov. 16, 2006

(65) Prior Publication Data

US 2009/0288441 A1 Nov. 26, 2009

(30) Foreign Application Priority Data

May 10, 2005 (DE) ..... 10 2005 021 560

(51) Int. Cl.
*F25D 17/04* (2006.01)

(52) U.S. Cl.
USPC ..... 62/418; 62/441; 62/408

(58) Field of Classification Search
USPC ..... 62/418, 419, 441, 426, 447
See application file for complete search history.

(56) References Cited

U.S. PATENT DOCUMENTS

| | | | | |
|---|---|---|---|---|
| 3,232,072 | A | 2/1966 | Barroero | |
| 3,232,073 | A | 2/1966 | Jobes et al. | |
| 3,834,177 | A * | 9/1974 | Scarlett | 62/288 |
| 5,896,752 | A | 4/1999 | Park | |
| 5,918,480 | A * | 7/1999 | Nagata et al. | 62/440 |
| 5,960,641 | A * | 10/1999 | Kim et al. | 62/407 |
| 2004/0050079 | A1 * | 3/2004 | Holmes et al. | 62/187 |
| 2004/0172964 | A1 * | 9/2004 | Brachert et al. | 62/407 |

FOREIGN PATENT DOCUMENTS

| | | | |
|---|---|---|---|
| JP | 4-363572 | 12/1992 | |
| JP | 8-247612 | 9/1996 | |
| JP | 8-303930 | 11/1996 | |
| JP | 2001-4262 | 1/2001 | |
| WO | WO 2004038312 A1 * | 5/2004 | F25D 17/08 |

OTHER PUBLICATIONS

International Search Report PCT/EP2006/061278.

* cited by examiner

*Primary Examiner* — Allana Lewin
*Assistant Examiner* — Max Snow
(74) *Attorney, Agent, or Firm* — James E. Howard; Andre Pallapies

(57) ABSTRACT

A refrigerating device is subdivided by a first partition into a storage zone and an air distribution zone. An air supply inlet and an air outlet open into the air distribution zone, and a plurality of holes are formed in the partition for letting air through from the air distribution zone into the storage zone and vice versa.

2 Claims, 3 Drawing Sheets

REFRIGERATING DEVICE WITH COOLING OF CIRCULATING AIR

The present invention relates to a refrigerating device with circulating air cooling, in other words a refrigerating device, in whose housing an evaporation region and a cooling region for receiving chilled goods are separated from each other and the cooling region is cooled by cold air supplied from the evaporation region. To obtain a closed air circuit, the cooling region must have an air supply aperture and an air discharge aperture and the air flows through the cooling region from the supply aperture to the discharge aperture.

High air flow speeds are achieved in direct proximity to the air supply and discharge apertures, which can cause unprotected chilled goods to dry out. Also if the desired temperature of the chiller compartment is not set favorably, there is a risk that chilled goods may be damaged by inflowing cold air, which is inevitably colder than the desired temperature.

The cooling region can be subdivided into a number of compartments by one or more bearing plates or other mountings, with the cold air flowing through said compartments one after the other.

When such a cooling region or a separated compartment therein is filled with a pull-out box, this impedes the air flow significantly. It is therefore proposed that the cooling air flow should be deflected along the side walls and base of such a box, to cool its interior through the box walls. The quantity of heat that can be dissipated in this manner per unit of time from the pull-out box may be small but this is acceptable, as the pull-out box, which is flushed with cold air all round, is only subject to a very small heat inflow from the surroundings of the refrigerating device. It is however disadvantageous that heat input from warm chilled goods freshly loaded into the pull-out box can only be dissipated very slowly. Also the flow paths required around the pull-out box require space, which is then no longer available to accommodate chilled goods.

The object of the invention is to create a refrigerating device cooled by circulating air, which allows unfavorable high flow speeds of the cold air to be avoided.

The object is achieved in that a cooling region, whereon an air supply and air discharge aperture are disposed, is subdivided by a first partition into a storage zone and an air distribution zone, in which the air supply and air discharge apertures are disposed and in that a plurality of holes is formed in the partition for the passage of air from the air distribution zone to the storage zone and vice versa. The partition therefore allows cooling one the one hand due to heat diffusion through the partition however also primarily due to the exchange of air, it being possible for an air exchange rate required for the required cooling capacity to be achieved at low air flow speeds in the storage zone, in that the air exchange with the air distribution zone is distributed over a large surface of the partition.

The air distribution zone is preferably subdivided by a thick second partition into an upstream section, into which the air supply aperture opens and from which air passes out into the storage zone, and a downstream section, into which the air discharge aperture opens and into which air passes from the storage zone. The second partition ensures that all the cooling air crosses the storage zone on the way from the air supply aperture to the air discharge aperture, absorbing heat there.

In order to achieve low air flow speeds with locally regular distribution in the storage zone, the partition should be as large as possible, preferably filling a side of the storage zone.

This side is preferably a cover of the storage zone, since the risk of chilled goods blocking the ingress or egress of the air is lowest there.

It is particularly expedient, if the storage zone contains a pull-out box, which is open at the top, since cold air can flow unimpeded into the box through the partition affixed to the cover of the storage zone and be extracted again therefrom.

Of the air supply aperture and air discharge aperture, one is preferably connected to a duct in the rear wall of the refrigerating device and the other faces an end aperture of a duct in the door of the refrigerating device.

It is preferably an air supply duct in the rear wall, while a discharge duct runs through the door, particularly in the case of a refrigerating device with a number of chiller compartments.

In order to prevent an air exchange between the compartments in a refrigerating device with a number of chiller compartments, which makes it difficult to control the temperature of both compartments independently, provision can be made for an intermediate wall separating the chiller compartments to be in contact with the door in its closed state by way of a seal.

In order to achieve regular distribution of the air flow over the surface of the first partition, a sheet of an air-permeable fiber material can be affixed to this, which easily collects up the arriving flow of air.

According to a particularly preferred refinement the first partition can be disassembled so that a user can remove it if necessary in order also to be able to use the air distribution zone to accommodate chilled goods.

Further features advantages of the invention will emerge from the description which follows of exemplary embodiments with reference to the accompanying figures, in which.

Figure 1:
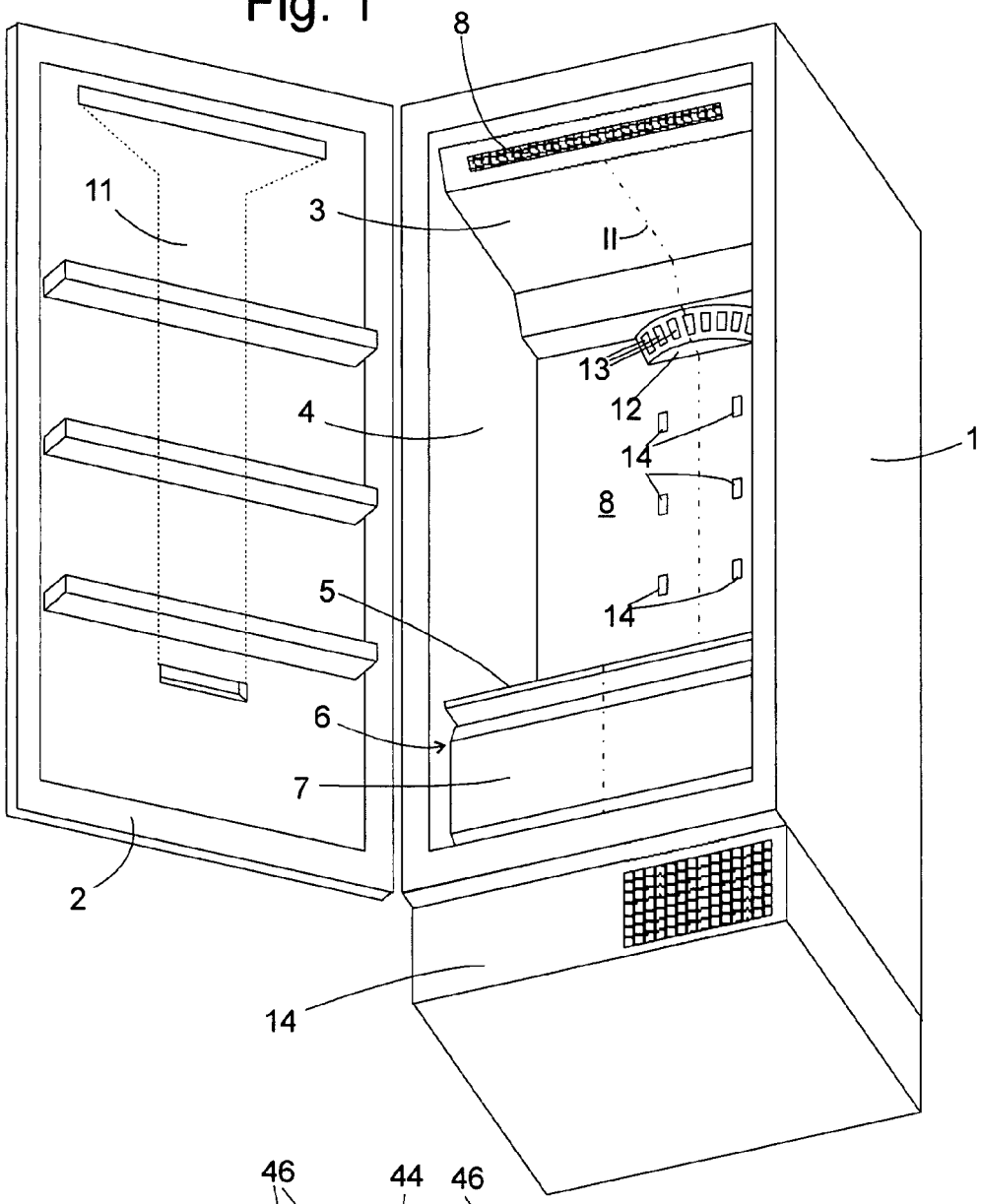
FIG. 1 shows a perspective view of a refrigerating device, on which the present invention is realized.

FIG. 1 shows a perspective view of a refrigerating device, based on which the present invention is to be described. The device has a body 1 and a door 2. The interior of the body 1 is subdivided into an evaporation region 3 at the top below the cover of the body 1, a first cooling region 4 and, separated from this by an insulating intermediate wall 5, a second cooling region 6. A pull-out box 7 is accommodated in the second cooling region 6. The first cooling region 4 is normally subdivided into compartments one above the other by a number of supports for chilled goods but these have been omitted from the figure, in order to be able to show as much as possible of the rear wall 8 of the body 1.

On the front face of an intermediate wall 9 (see FIG. 2) separating the evaporation region 3 from the first cooling region 4 an air inlet aperture 10 is formed, through which the air from the first cooling region 4 can enter the evaporation region 3. Lines, through which the air from the second cooling region 6 can flow to the evaporation region 3—not visible in the figure—can be located in side walls of the body 1; another option shown in the figure is an air line 11 in the interior of the door 2, which starts at the level of the second cooling region 6 and ends opposite the air inlet aperture 10, the course of which is shown with broken lines in the figure.

A distribution hood 12 is fixed to the intermediate wall 9 adjacent to the rear wall 8, a plurality of air holes 13 being formed thereon, through which cold air moving from the evaporation region 3 is distributed in diverse directions in the upper part of the first cooling region 4. A number of pairs of apertures 14, from which cold air can also flow, are located on the rear wall 8 below the distribution hood 12. The level of these pairs of apertures 14 is selected such that when chilled goods supports are mounted in the first cooling region 4, each pair of apertures 14 supplies one compartment.

Figure 2:
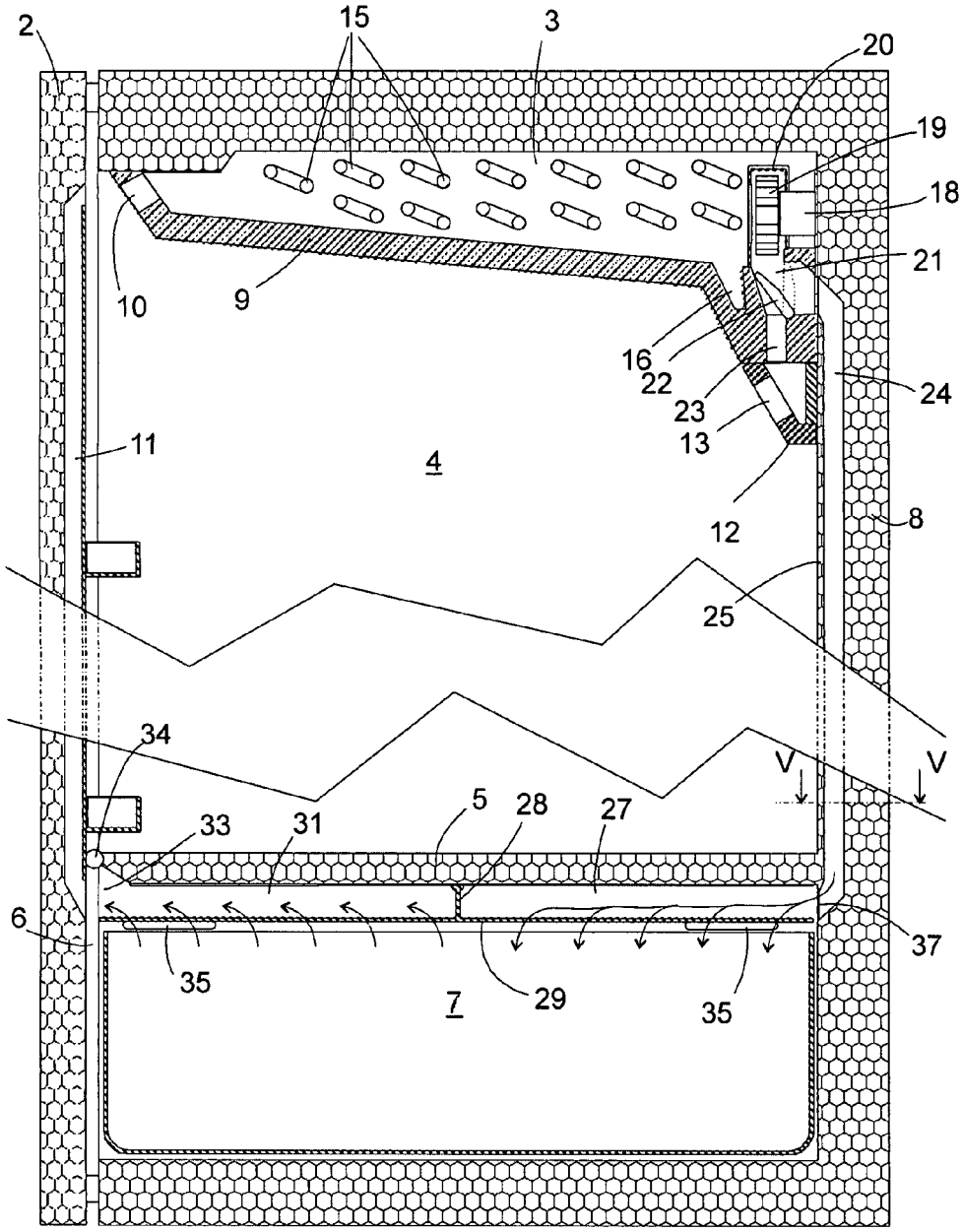
FIG. 2 shows a section through the refrigerating device in FIG. 1 along the line II from FIG. 1.

FIG. 2 shows a section of the refrigerating device in FIG. 1 along a center plane extending vertically and toward the bottom of the body 1, represented by a dot-dash line II in FIG. 1. In the section cooling hoses of an evaporator 15 are shown in the interior of the evaporation region 3, to which cooling hoses air penetrating through the air inlet aperture 10 flows. The intermediate wall 9 slopes down toward the rear wall 8 of the body 1 to a channel 16, in which condensate dripping from the evaporator 15 is collected. The condensate reaches an evaporation unit accommodated in the base region 17 (see FIG. 1) of the body 1 by way of a pipe (not shown).

A fan, having a motor 18, a bucket wheel 19 driven by said motor 18 and a housing 20, is accommodated behind the channel 16, adjacent to the rear wall 8. An intake aperture is formed on the front face of the housing 20, in the axial direction of the bucket wheel 19. The upper half of the housing 20 runs closely round the bucket wheel 19 in the peripheral direction; the housing 20 is open at the bottom so that air that is accelerated radially outward due to rotation of the bucket wheel 19 flows down into a chamber 21.

A pivotable flap 22 is accommodated in this chamber 21. In the position shown in the figure the flap 22 blocks a cold air supply aperture 23, which leads vertically downward to the first cooling region 4. The air is thus pushed toward the rear wall 8 and into a cold air supply path 24, which leads from the first cooling region 4, separated by a thin insulating layer 25, to the second cooling region 6 in the interior of the rear wall 8. When the flap 22, which is linked to an intermediate wall 26 between the cold air supply aperture 23 and the cold air supply line 24 is moved to a vertical position, shown as a dotted outline in the figure, it blocks the cold air supply path 24 and the cold air flow reaches the distribution hood 12 through the cold air supply aperture 23. The figure shows one of the air holes 13, through which air flows out of the distribution hood 12 into the first cooling region 4.

The cold air supply path 24 leads to a cold air supply aperture 37 of the second cooling region 6 and reaches a first distribution chamber 27 there, which extends perpendicular to the sectional plane in FIG. 2 over the entire width of the second cooling region 6 and over roughly half its depth to a vertical partition 28. The vertical partition is molded from plastic as a single piece with a horizontal partition 29. The horizontal partition 29 forms the base of the first distribution chamber 27 and separates this from a storage zone of the second cooling region below. It is provided with a plurality of apertures 30 (see FIG. 3), by way of which cold air supplied to the distribution chamber 27 by way of the supply path 24 is widely distributed as it enters the storage zone and the pull-out boxes 7 accommodated therein that open at the top.

A second distribution chamber 31 is located in a mirror image of the first distribution chamber 27 between the vertical partition 28 and the door 2. The widened upper edge of the partition 28 adjoining the intermediate wall 5 between the cooling regions 4 and 6 separates the distribution chambers 27, 31 from each other and prevents or limits a direct passage of cold air from the chamber 27 to the chamber 31. To create an effective air block between the chambers 27, 31, the upper edge of the partition 28 can be provided with a sealing strip (not shown in the figure), which is compressed between it and the intermediate wall 5 and establishes a close contact. It is however also acceptable for there to be a narrow gap between the upper edge of the partition 28 and the intermediate wall 5, as long as the air flow through this gap remains small compared with the air flow from the first distribution chamber 27 into the pull-out box 7.

The air flows out of the pull-out box 7 through apertures 32, formed in the horizontal partition 28 between the storage zone and the second distribution chamber, into the latter. Opposite an air discharge aperture 33 on the side of the second distribution chamber 31 facing the door is an inlet aperture of the air line 11 leading through the door 2 back to the evaporation region 3. A sealing strip 34 fixed to the front edge of the intermediate wall 5 and compressed between this and the door 2 prevents a passage of air from the distribution chamber 31 into the first cooling region 4, thereby ensuring that the two cooling regions 4, 6 can be provided with cold air separately and without influencing each other.

The component forming the partitions 28, 29 is mounted in a removable manner in the second cooling region 6; in the instance considered here its lateral edges rest on studs 35, which each project a few millimeters from the side walls of the second cooling region 6. This allows the user to remove the partitions 28, 29 and fill the pull-out box 7 to above its upper edge with chilled goods, should this be necessary.

Figure 3:
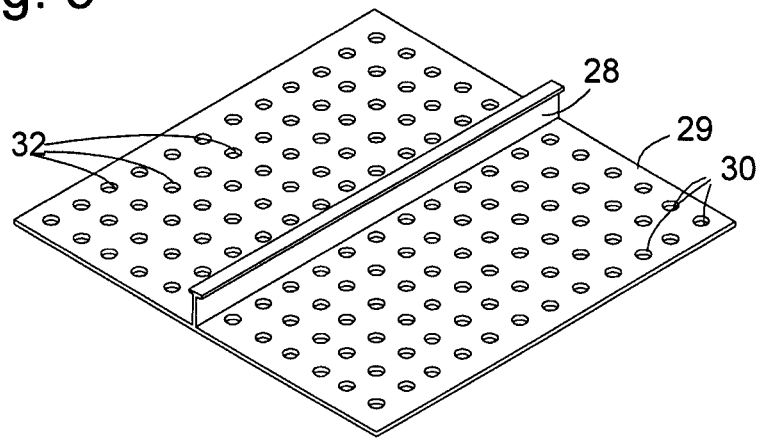
FIG. 3 shows a view of a first refinement of the first and second partitions.
Figure 4:
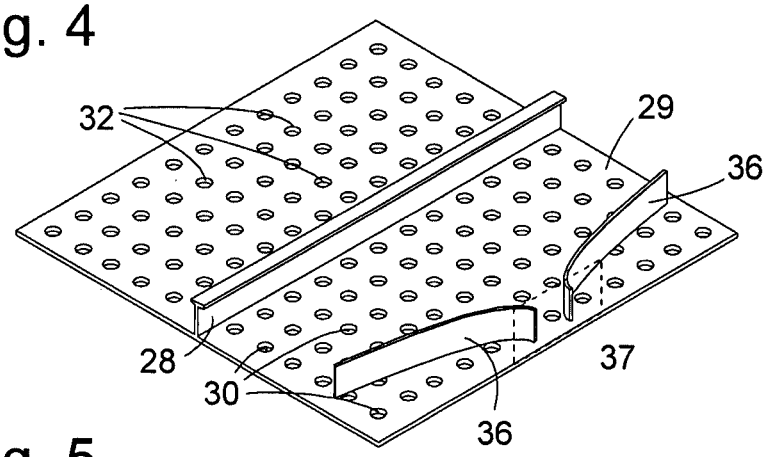
FIG. 4 shows a view of a second refinement of the partitions.

FIG. 3 shows a perspective view of the component forming the partitions 28, 29 according to a first refinement. The vertical partition 28 divides the horizontal 29 into two subsurfaces of equal size, in which the apertures 30 and 32 are distributed in a regular pattern. In the modified refinement in FIG. 4 two curved ribs 36 projecting into the first distribution chamber 27 are formed on the horizontal partition 29, serving to deflect part of the cold air flow entering the first distribution chamber 27 through the cold air supply aperture 37 shown as a broken outline at the lower end of the cold air supply path 24 to the side, to achieve a regular distribution of the air throughput to the apertures 30 or in some instances even a somewhat higher throughput at the apertures 30 located more toward the rear wall 8.

To achieve a similar effect, it would also be possible based on a modification (not shown) to vary the thickness of the cross-sectional surface of the apertures 30 over the horizontal partition 29 toward the bottom of the body 2, in particular to make the apertures 30 and 32 in proximity to the rear wall 8 or the door 2 larger than in proximity to the vertical partition 28.

Figure 5:
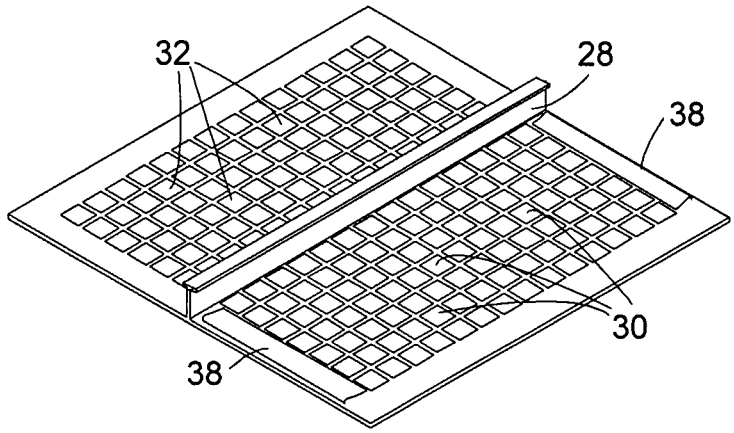
FIG. 5 shows a view of a third refinement of the partitions.

In the refinement shown in FIG. 5 the apertures are made so large that the horizontal partition 29 is reduced to a grid to some extent. In order to distribute the air flowing out of the distribution chamber 31 regularly over the surface of the partition 29 here, a rectangular piece of fleece or fabric (not shown in the figure) is provided here as a means for generating a flow resistance, covering the apertures 30 and being held in place with the aid of elastic clips 38. In order also to distribute the discharge of air into the second distribution chamber 31 regularly through the apertures 32, fleece or fabric can also be attached to these.

Figure 6:
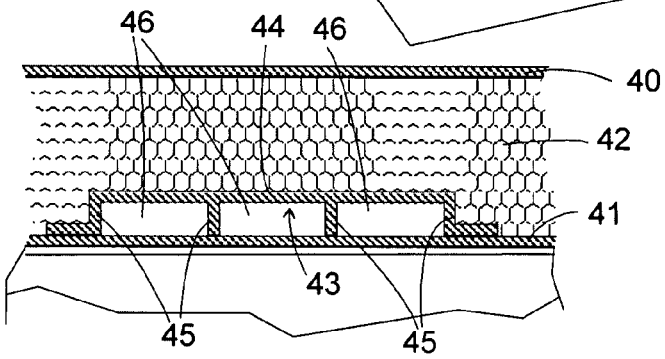
FIG. 6 shows a horizontal partial section through the door of the refrigerating device.

FIG. 6 shows a segment of a horizontal section through the door 2. In the conventional manner the door 2 has a solid outer skin 40, a solid inner skin 41 and an insulating layer 42 filling the cavity between. An extruded section 43 attached to the inner skin 41, for example by means of adhesive, projects into this insulating layer 42. The extruded section 43 has a base 44 facing the outer skin 40, from which four studs 45 stand out, distributed over its width. Together with the inner skin 41 the extruded section 43 bounds three ducts 46, which together form the air line 11. Since this air line 11 runs directly along the inner skin 41, the air circulating in it, if it is colder than the first cooling region 4, can additionally cool areas of the first cooling region 4 in proximity to the door, which are conventionally not as effectively cooled as areas close to the rear wall 8, thus contributing to a particularly regular temperature distribution in the first cooling region 4.

The invention claimed is:

1. A refrigerating device comprising:

a.) a first cooling region;

b.) at least one air supply aperture;

c.) an air discharge aperture, the first cooling region being supplied with cold air delivered thereto in a forced air circulation manner under the motive force of a fan with the cold air being supplied by way of the at least one air supply aperture and air exiting the first cooling region exiting via the air discharge aperture; and d.) a first partition that subdivides the first cooling region into a storage zone in which items to be cooled are stored and an air distribution zone, the air supply aperture and the air discharge aperture being communicated with the air distribution zone and the first partition having a plurality of holes for the passage of air therethrough such that air travels from the air distribution zone to the storage zone via the plurality of holes and air travels from the storage zone to the air distribution zone via the plurality of holes; and wherein the air distribution zone is subdivided by a second partition into an upstream area and a downstream area, the upstream area of the air distribution zone being communicated with the air supply aperture and with the storage zone such that cold air is supplied into the upstream area and all of the supplied cold air exits the upstream area into the storage zone, and the downstream area of the air distribution zone being communicated with the air discharge aperture and with the storage zone such that air exits the storage zone into the downstream area and thereafter exits the downstream area via the air discharge aperture; and a second cooling region separate from the first cooling region, and an intermediate wall, the second partition being molded as a single part on the first partition and having a free end, the free end of the second partition adjoining the intermediate wall, the intermediate wall separating the first cooling region from the second cooling region in a thermally insulating manner.

2. The refrigerating device as claimed in claim 1, wherein the second partition serves as a deflection element, deflecting the cooling air flowing into the first cooling region toward the first partition.

* * * * *